United States Patent [19]

Kobayashi et al.

[11] 4,253,916

[45] Mar. 3, 1981

[54] VIBRATORY PLATING METHOD

[75] Inventors: Hisamine Kobayashi, Nagoya; Motoo Kawasaki, Hirakata; Shozo Mizumoto, Takarazuka; Hidemi Nawafune, Takatsuki; Sadamasa Suzuki, Tatsuta, all of Japan

[73] Assignee: Shikishima Tipton Mfg. Co., Ltd., Nagoya, Japan

[21] Appl. No.: 76,951

[22] Filed: Sep. 19, 1979

Related U.S. Application Data

[62] Division of Ser. No. 16,144, Feb. 28, 1979.

[51] Int. Cl.[3] ..... C25D 5/00; C25D 17/18

[52] U.S. Cl. ..... 204/14 R; 204/23

[58] Field of Search ..... 204/23, 14 R

[56] References Cited

U.S. PATENT DOCUMENTS

| | | | |
|---|---|---|---|
| 1,916,492 | 7/1933 | Schuricht | 204/23 |
| 2,721,834 | 10/1955 | Koury | 204/23 |
| 3,397,126 | 8/1968 | Gilbert | 204/23 |
| 3,420,766 | 1/1969 | Michelson | 204/222 |
| 3,649,490 | 3/1972 | Nolan | 204/222 |
| 3,699,014 | 10/1972 | Eisner | 204/222 |
| 3,771,266 | 11/1973 | Kobayashi | 51/163 |
| 3,811,231 | 5/1974 | Kobayashi | 51/163 |
| 3,897,658 | 8/1975 | Kobayashi | 51/163 |
| 3,935,680 | 2/1976 | Kobayashi | 51/313 |
| 3,948,002 | 4/1976 | Kobayashi | 51/163 V |

*Primary Examiner*—T. M. Tufariello

*Attorney, Agent, or Firm*—Wenderoth, Lind & Ponack

[57] ABSTRACT

A vibratory plating method carried out by placing only workpieces and a plating liquid in a plating container, and applying an electric current across the plating liquid while vibrating the plating container so as to cause the workpieces to be plated as the workpieces are rolled and moved independently of one another along the plating container. By this plating method, workpieces can be plated uniformly in a very short period of time at a high current density and with a small amount of plating liquid. Moreover, it eliminates troublesome steps of manually suspending and removing workpieces from hangers.

13 Claims, 8 Drawing Figures

VIBRATORY PLATING METHOD

This application is a divisional of application Ser. No. 16,144, filed Feb. 28, 1979.

BACKGROUND OF THE INVENTION

1. Field of the Invention

The present invention relates to a vibratory plating method which improves plating efficiency by vibrating a plating container with plating liquid therein to maintain a uniform concentration of metal ions in the vicinity of cathodes.

2. Description of the Prior Art

In a conventional plating method using a barrel, workpieces are inserted in a plating liquid in the barrel and the barrel is rotated or rocked to bring the workpieces into sliding contact with cathodes and subject the workpieces to electrodeposition. Barrel type plating methods include one using an open-top bottle type barrel which is rotated while being inclined, and another one using a rectangular or cylindrical barrel having small apertures in the entire wall thereof and being horizontally disposed in a plating liquid, and rotated or rocked to agitate the plating liquid to effect the plating of the workpieces. In the use of an inclined barrel type plating apparatus, the temperature and the concentration of the plating baths are frequently subject to changes, the insertion and withdrawal of workpieces cannot be easily carried out, and anodes having a large surface area cannot be employed.

In the horizontal barrel type plating method using a horizontal barrel type plating apparatus, an electric current flows through small apertures in the side wall of the barrel. Thus the plating container requires a far higher voltage than the plating container used in other plating methods in which workpieces are suspended in a plating liquid. As a result, a large amount of energy is consumed, and sparks jump across the contacts of cathode lead wires and workpieces so that the surfaces of workpieces are burnt or have holes made therein by burning. In addition, the power source and other parts will often be damaged and the plating operation cannot be conducted smoothly in many cases.

Plating with 3–4 microns of nickel cannot be carried out efficiently in a horizontal barrel type plating apparatus or it usually requires 60 to 90 minutes of electrodeposition even if the diameters of the apertures in the side wall of the plating barrel are increased. In addition, the amount of plating liquid removed from the plating barrel in a method using this apparatus is larger than that in a widely used plating method carried out with workpieces suspended in a plating liquid. This causes the composition of the plating bath to be changed. In other words, quality control cannot be carried out easily. The large amount of plating liquid removed from the plating barrel has caused trouble in the treatment of the waste water which is necessary for preventing the occurrence of environmental pollution, and has adversely affected the economy of the plating process.

These conventional plating processes have many other drawbacks in addition to those described above. They have a low productivity and the apparatus used requires a large floor space. Consequently, the quantity and dimensions of the workpieces to be plated are limited. In fact, the conventional barrel type plating processes have many problems yet to be solved including the above-mentioned problem of treatment of the waste water. Namely, in a conventional barrel type plating method, the plating of workpieces cannot be satisfactorily carried out unless they are soaked completely in a large amount of plating liquid while being rotated or rocked. Moreover, the coating plated on the workpieces does not have a uniform thickness on each part of the surfaces because of sufficient agitation of the plating liquid.

SUMMARY OF THE INVENTION

An object of the present invention is to eliminate the drawbacks described hereinbefore in connection with the conventional plating methods.

Another object of the present invention is to provide an ideal vibratory plating method in which only a plating liquid and workpieces are placed in a vibratory plating container and an electric current is applied to the plating liquid for carrying out the plating process.

Still another object of the present invention is to provide a vibratory plating method which enables the carrying out of plating processes at a high efficiency which is double that of a conventional method, because the workpieces are rolled and displaced in the bottom portion of a vibratory container containing a quantity of a plating liquid which is equal to or less than a third that used in a conventional method.

Still another object of the present invention is to provide an improved vibratory plating method in order to provide a uniform coating thickness on all parts of the workpiece surfaces by imparting vibratory action to the plating liquid to agitate it sufficiently.

To these ends, the present invention provides a vibratory plating method comprising inserting workpieces and a plating liquid in a plating container, and applying an electric current to the plating liquid while vibrating the plating container so as to cause the workpieces to be plated as the workpieces are rolled and moved independently of one another along the plating container.

The above and other objects as well as advantageous features of the invention will become apparent from the following description of the preferred embodiments taken in conjunction with the accompanying drawings.

DESCRIPTION OF THE PREFERRED EMBODIMENTS

Figure 1:
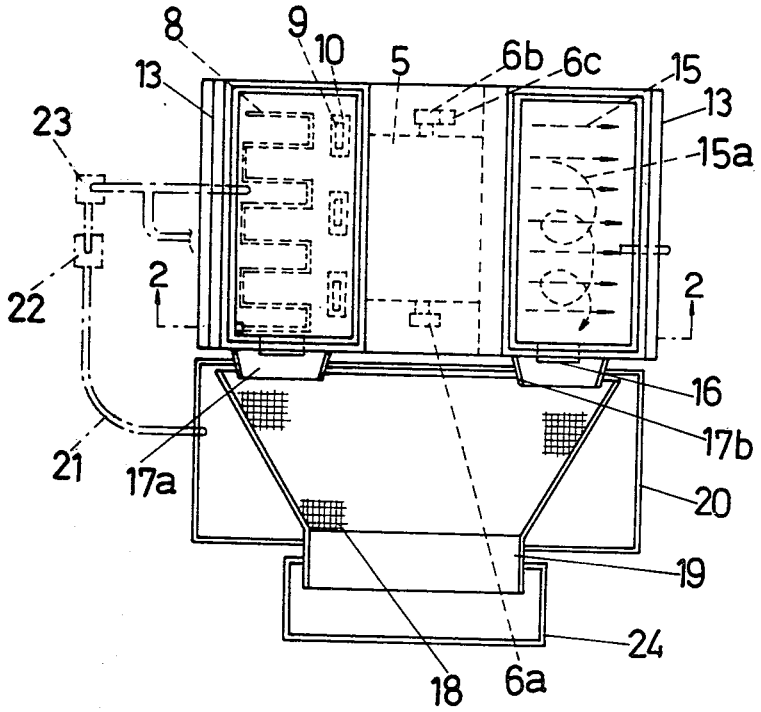
FIG. 1 is a plan view of a duplex tub type vibratory plating apparatus.

The parts, workpieces, and arrows showing the directions of the flow of the mass in a plating container, which are common to all of those drawings, are represented by the same reference numerals.

Figure 2:
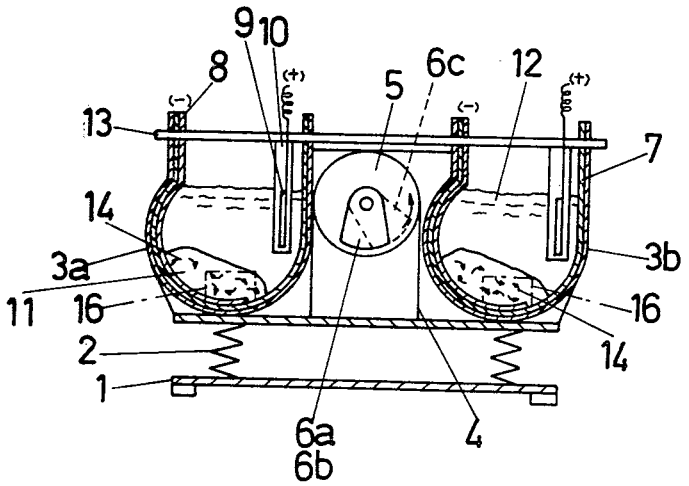
FIG. 2 is a cross-sectional view taken along the line 2—2 in FIG. 1.

Referring to FIGS. 1 and 2, tubs 3*a* and 3*b* are mounted on springs 2 which are provided on a base 1. Unbalanced weights 6*a* and 6*b* are secured to the opposite ends of a shaft of a vibratory motor 5 disposed between the tubs 3*a* and 3*b*. Anode plates 9 covered with films 10 are immersed in a plating liquid 12 in the tubs 3*a* and 3*b*, the inner surfaces of which are lined with electrically insulating members 7 made of rubber, vinyl, or urethane. These anode plates 9 are secured to lids 13. Cathode plates 8 are disposed on the opposite side facing the anode plates 9 in the tubs 3*a* and 3*b*, and are secured to the lid 13 in the same manner as the anode plates 9 with the upper end portions thereof projecting out of the tubs 3*a* and 3*b*. Conductors from an external power source (not shown) are connected to the anode plates 9 and cathode plates 8 so that an electric current can be made to flow therethrough, respectively. A plating liquid is contained in the tubs 3*a* and 3*b*. Workpieces 11 in the plating tubs 3*a* and 3*b* to which an electric current is supplied may be free or fixed to the cathode plates 8. The workpieces 11 gathered in the bottom portions of the tubs 3*a* and 3*b* are rolled and circularly transferred individually and independently of one another as shown by the arrows 14 (in FIG. 2) when the vibratory motor 5 is driven. This causes the density of ions around the workpieces 11 to be uniform at all times, and the workpieces 11 can be plated uniformly at a high speed. In this case, the general movements of the contents of the vibratory plating tubs 3*a* and 3*b* are affected by the lead angle of the unbalanced weights 6*a* and 6*b*. When there is no lead angle between the unbalanced weights 6*a* and 6*b*, the contents of the tubs 3*a* and 3*b* are circulated (in one direction) in planes at right angles to the axis of the tubs 3*a* and 3*b* as shown by arrows 15 in FIG. 1. When a lead angle of approximately 15°–90°, preferably 30°, is provided in the direction of rotation of the contents of the tubs 3*a* and 3*b* to the unbalanced weight 6*b* to move the same to a position 6*c* after a plating process has been completed, the contents of the tubs 3*a* and 3*b* are moved with a spiral motion of a large pitch in the direction of the arrow 15*a*, and are discharged from discharge ports 17*a* and 17*b*. Discharged workpieces 11 are fed into a receptacle 24 via a screen 18 and an outlet 19, while the discharged plating liquid is collected in a tank 20 disposed under the screen 18. The liquid collected in the tank 20 then flows into a conduit 21 connected at one end to the tank 20 and at the other end to the tubs 3*a* and 3*b*, and is filtered in a filter 22. The filtered liquid is then returned to the tubs 3*a* and 3*b* by means of a pump 23 for use with the next cycle of the plating process.

In the apparatus shown in FIGS. 3–8, the contents of a bowl 3 are circulated in planes including the vertical axis thereof. When a lead angle of 15°–45°, preferably 30°, is given to a lower unbalanced weight 6*a* in the direction of rotation of the contents of the bowl 3 with respect to an upper unbalanced weight 6*b*, during the plating operation workpieces are independently rolled and transferred as indicated by arrows 14*a*, 14*b* and 14*c* and the general contents of the bowl 3 are circulated with a spiral motion of a small pitch as indicated by arrows 15*b*, 15*c*, and 15*d*. In order to separate the workpieces after the plating operation has been completed, a lead angle of 60°–120°, preferably 90°, in the direction of rotation of the contents of the bowl 3 is given to the lower unbalanced weight to impel the contents of the bowl 3, and the contents are moved with a spiral motion of a large pitch as indicated by the broken-line arrow 15*a*. A lead angle of 15°–45°, preferably 30°, to be given to the lower unbalanced weight may then be chosen for the plating operations. On the contrary, a lead angle of 60°–120°, preferably 90°, may be chosen for withdrawing the contents of the bowl after the plating operation has been completed. These lead angles may be utilized for automatically vibrating the plating liquid. In the case where workpieces are fixed to the cathodes, a movable weight for withdrawing the workpieces is not needed and in that case a fixed unbalanced weight may be used for causing the vibration of the plating liquid.

According to the present invention described above, the plating efficiency and plating rate can be improved by use of the vibrating container. Namely, according to the present invention, a large quantity of workpieces can be loaded at one time in a plating container, and the current efficiency can be improved since a container having small apertures in the wall thereof which shelters the electric current can be omitted. In addition, the workpieces in the plating container are vibrated so as to be rolled and transferred independently of one another and simultaneously circulated with a spiral motion of a small pitch as shown by arrows 15. This causes the density of ions around the workpieces to be uniform so that the plating operation can be speeded up.

Figure 3:
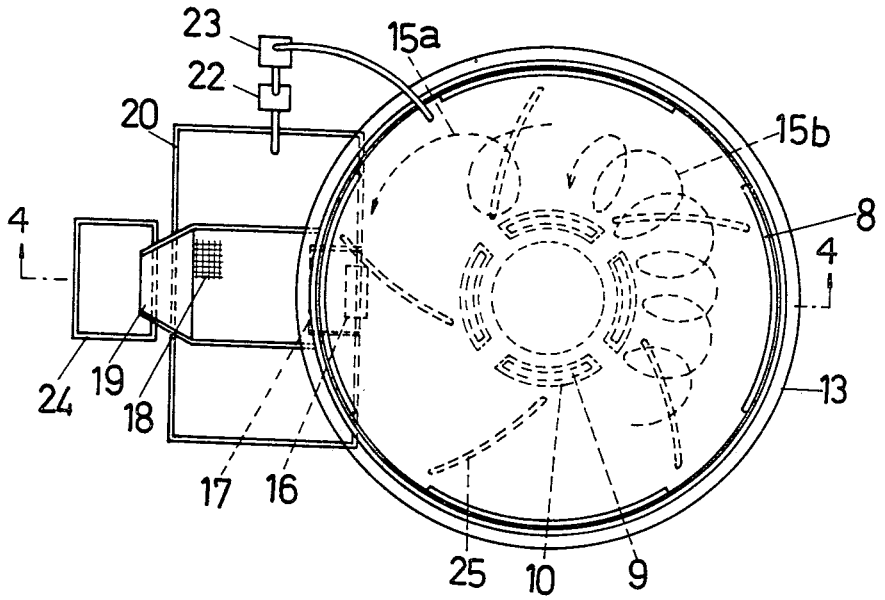
FIG. 3 is a plan view of an annular vibratory plating apparatus.
Figure 4:
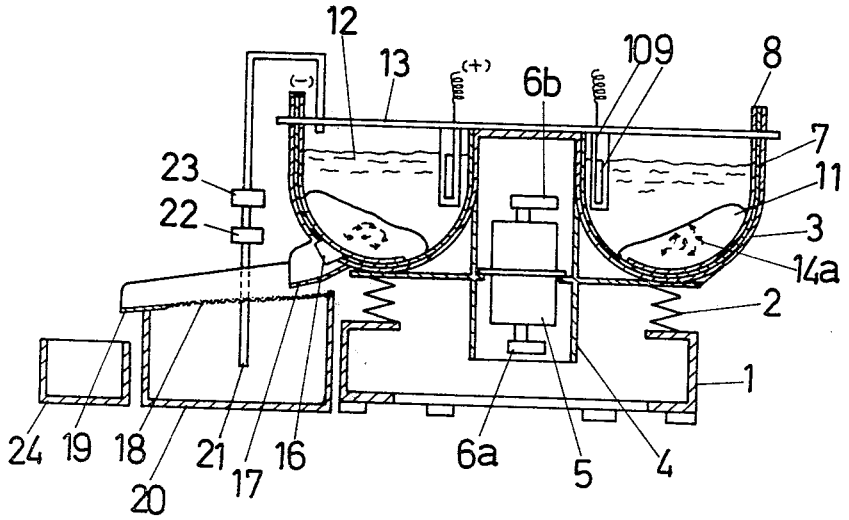
FIG. 4 is a cross-sectional view taken along line 4—4 in FIG. 3.
Figure 5:
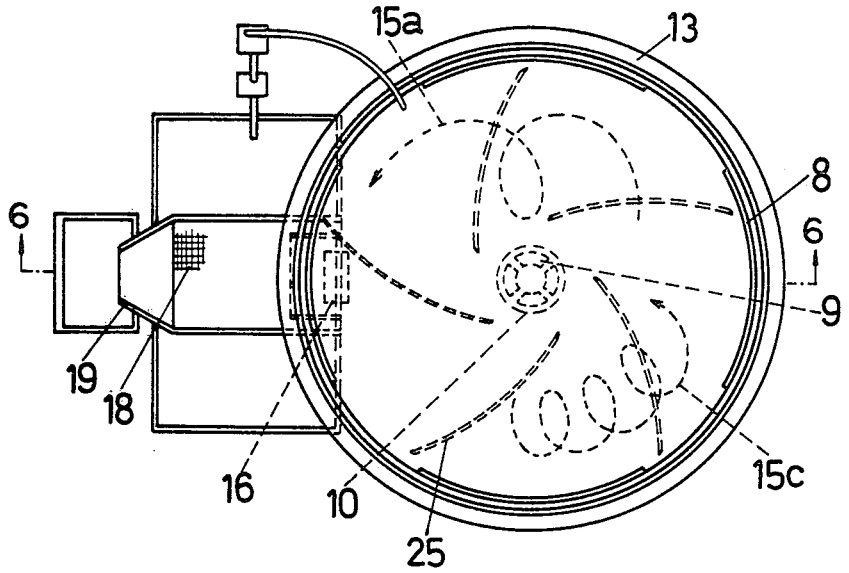
FIG. 5 is a plan view of a core-less vibratory plating apparatus.
Figure 6:
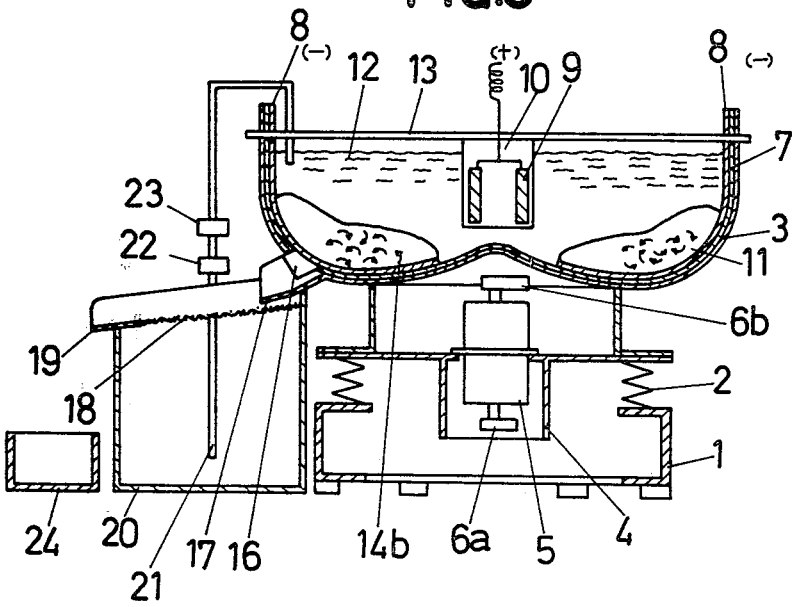
FIG. 6 is a cross-sectional view taken along the line 6—6 in FIG. 5.
Figure 7:
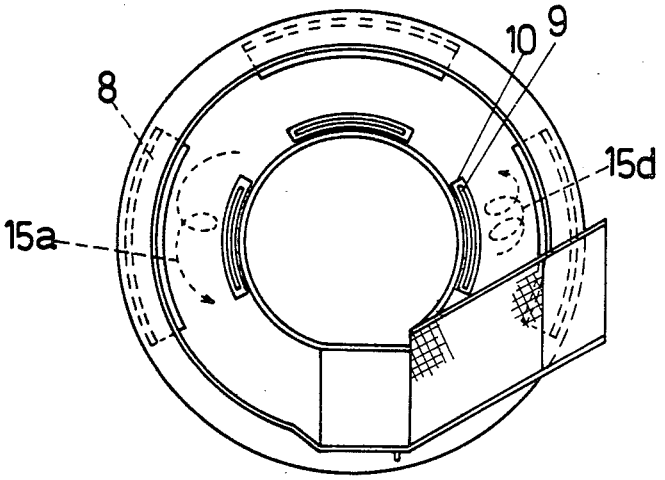
FIG. 7 is a plan view of a spiral vibratory plating apparatus.
Figure 8:
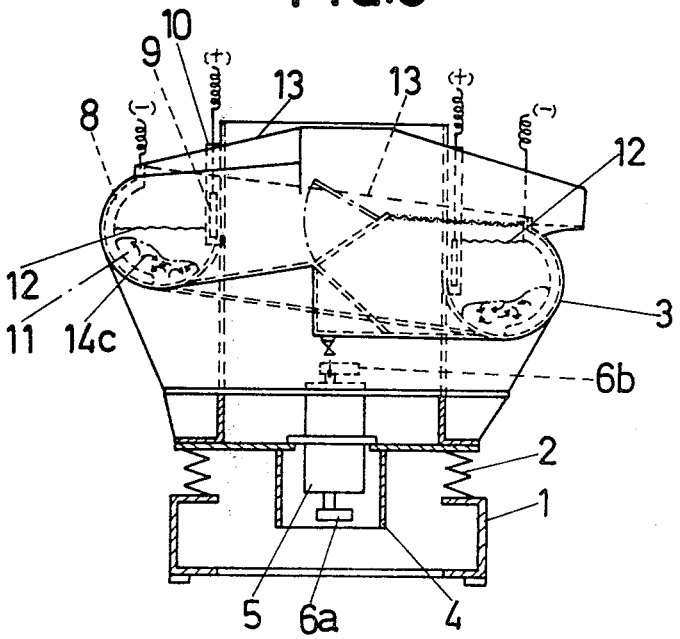
FIG. 8 is a front elevational view of the plating apparatus shown in FIG. 7.

Since workpieces are rolled and transferred whether a deflector 25 such as shown in FIGS. 3 and 5 is provided in the container 3 or not, any diffusion layer formed on the surface of cathodes during the electrolysis is thin. As a result, an electric current of a high density can be used. Therefore, the plating method using plating containers according to the present invention increases the productivity to a higher level.

In a conventional plating method using a plating container, the plating liquid is withdrawn through the apertures in the side wall of the container after the electrolysis process has been completed, and it has therefore been very difficult to withdraw the plating liquid completely. However, according to the plating method of the present invention, workpieces alone can be sent to the following step and thus, the quantity of the plating liquid removed from the plating container is greatly reduced. This means that the loss of the plating liquid can be kept to a minimum In a generally used plating method in which workpieces are suspended in a plating liquid, it is the most troublesome at present to manually suspend the workpieces and remove the same. This troublesome step and the involved labor can be eliminated by use of the plating method according to the present invention.

In a generally used plating method referred to above in which a plating barrel is used, only comparatively smallsize workpieces are treated because with larger workpieces indentions are formed in the workpieces due to their violent impact with each other and the machine, and because of the limited mechanical strength of the machine to resist such impact. In the plating method according to the present invention, however, comparatively large workpieces, which are at present plated while being suspended from hooks, can also be treated in a plating container.

Unlike a conventional plating method using a plating barrel, the plating method according to the present invention transfers only plated workpieces to the next step, and accordingly, the plating operation can be automated.

Unlike a conventional plating method in which abrasive chips are used, the plating apparatus according to the present invention causes no decrease in current efficiency, and the plated surface of a workpiece is not contaminated with small fragments of abrasive chips. In fact, the present invention provides an ideal plating method which carries out a plating process at a high rate.

Plating materials usable in the method according to the present invention are mainly copper, nickel, zinc and chromium. An example of the present invention is shown and described below.

EXAMPLE

Apparatus: Tub-type vibratory plating apparatus.
Capacity: 2 liters
Plating liquid: Solution of nickel, 1.5 liter watt bath; and 2.5 g/liter of 1,3,6-naphthalene sodium sulfonate and 0.025 g/liter of 1,4-butyne diole as brighteners.
Test pieces: 2000 dry cell caps of 10 mm (dia.)×2.7 mm.
Frequency: 800–1500 cpm
Amplitude: 0.5–3 mm
Amperage: 4 A
Thickness of plating:
Target thickness: 5.3 microns
Average thickness obtained: 5.29 microns The results of the experiment conducted under the above-described conditions are as follows. The variance of thickness of the plating on the test pieces is small. The plating time is reduced to half the time required in a conventional plating method. Manual suspending of workpieces can be eliminated. The surface of the workpieces is uniformly plated with the same thickness at all their parts. Even light workpieces like the test pieces used in this experiment can be uniformly rolled in the bottom portion of a vibratory container without floating. The plating operation can be conducted at a very high efficiency at a high current density.

The present invention is not, of course, limited to the above embodiments; it may be modified within the scope of the appended claims.

What is claimed is:

1. A method of plating workpieces in a plating container comprising:

providing a base and a vibratory plating container means resiliently mounted on the base, the container means having a lid covering the top and having a bottom with a concavely arcuate cross-section;

filling the container means with individual workpieces to be plated and a plating liquid;

vibrating the container means with a provided vibration generating means connected between the base and vibratory plating container means, the vibration causing workpieces in the container means to roll and to be transferred in a direction along the container means parallel to the bottom thereof;

generating an electric field through the plating liquid with electrodes of opposite polarities provided within the container means;

discharging a mixture of plated workpieces and plating liquid through a discharge port provided on one side of the arcuate bottom of the container means;

receiving the mixture from the discharge port and separating the workpieces from the plating liquid with a screening means provided below and separate from the container means; and returning the separated plating liquid to the container means with a provided liquid return means connected between the container means and the screening means.

2. A method as claimed in claim 1, wherein the step of providing the vibratory container means includes providing a horizontal vibratory plating tub.

3. A method as in claim 1, wherein the step of providing the vibratory container means includes providing a pair of side-by-side horizontally positioned tubs and wherein the step of providing the vibration generating means includes positioning the provided vibration generating means between the tubs.

4. A method as in claim 1, wherein the step of providing the container means includes providing a horizontally positioned annular tub, and wherein the step of providing the vibration generating means includes positioning the provided vibration generating means in the center of the tub.

5. A method as claimed in claim 1, wherein the step of providing the container means includes providing an open-topped tub having an annular groove around the periphery of the bottom thereof forming the concavely arcuate cross-section, and wherein the step of providing the vibration generating means includes positioning the vibration generating means below the center of the tub.

6. A method as claimed in claim 1, wherein the step of providing the container means includes providing a spiral-shaped tub and wherein the step of providing the vibration generating means includes positioning below the center of the tub.

7. A method as claimed in claim 1, wherein the step of generating an electric field by providing electrodes includes attaching the electrodes to the lid.

8. A method as in claim 1, wherein the step of providing electrodes includes providing a cathode electrode positioned in the path of the individual workpieces and wherein the step of vibrating the container means with the vibration generating means includes moving the individual workpieces along the inner wall of the container means.

9. The method as claimed in claim 1, wherein the step of vibrating the container means with the vibration generating means includes the step of providing a motor having a rotary shaft and a pair of unbalanced plates secured to the respective ends of the rotary shaft, thereby causing vibration of the container means during the rotation of the motor.

10. A method as claimed in claim 1, wherein the step of filling the container means with the plating liquid includes providing sufficient quantitites of plating liquid to the individual workpieces submerged in the plating liquid during the rolling and movement of the workpieces within the container means.

11. A method as claimed in claim 1, wherein the step of vibrating the container means with the provided vibrating means includes vibrating the container means so as to move the individual workpieces within the plating container means in a unidirectional circular flow path during the rolling movement of the individual workpieces.

12. A method as claimed in claim 1, wherein the step of filling the container means with the plating liquid includes providing a plating liquid selected from the group consisting of nickel, cooper, zinc, and chromium plating liquids.

13. A method as claimed in claim 1, wherein the step of generating an electric field by providing electrodes includes providing a cathode electrode located along the outer wall of the container and wherein the step of vibrating the container means with the vibration generating means includes moving the individual workpieces in sliding contact with the cathode electrode during the rolling and the movement of the individual workpieces.

* * * * *